United States Patent [19]

Reno et al.

[11] Patent Number: 4,713,167

[45] Date of Patent: Dec. 15, 1987

[54] MULTIPLE SINGLE-STAGE HYDROCRACKING PROCESS

[75] Inventors: Mark E. Reno, Villa Park; Robert K. Olson, Elgin; Tom N. Kalnes, La Grange, all of Ill.

[73] Assignee: UOP Inc., Des Plaines, Ill.

[21] Appl. No.: 876,640

[22] Filed: Jun. 20, 1986

[51] Int. Cl.[4] ..... C10G 65/10

[52] U.S. Cl. ..... 208/59; 208/89; 208/111; 208/112; 208/169

[58] Field of Search ..... 208/57, 58, 59, 89, 208/169, 111, 112

[56] References Cited

U.S. PATENT DOCUMENTS

| | | | |
|---|---|---|---|
| 3,037,930 | 6/1962 | Mason | 208/59 |
| 3,166,489 | 1/1965 | Mason et al. | 208/57 |
| 3,540,999 | 11/1970 | Jacobs | 208/59 |
| 3,697,413 | 10/1972 | Hamblin | 208/89 |
| 3,891,539 | 6/1975 | Nelson et al. | 208/59 |
| 4,197,184 | 4/1980 | Munro et al. | 208/89 |
| 4,404,088 | 9/1983 | Batchel et al. | 208/59 |

*Primary Examiner*—Andrew H. Metz
*Assistant Examiner*—Anthony McFarlane
*Attorney, Agent, or Firm*—Thomas K. McBride; John F. Spears, Jr.; Thomas J. Filarski

[57] ABSTRACT

A multiple single-stage process for the conversion of heavy hydrocarbonaceous charge stock into a lower boiling distillate hydrocarbon product. Fresh charge stock and hydrogen are introduced into a first catalytic reaction zone for substantially 100% conversion of the feed. Hydrocracked product effluent from the first hydrocracking reaction zone which comprises a predetermined distillate fraction is passed with an accucracked effluent from a second catalytic hydrocracking or accucracking reaction zone into a separation zone and separated into various hydrocarbon streams including a light hydrocarbon stream comprising the distillate product, a middle hydrocarbon stream and a heavy hydrocarbon stream. The middle hydrocarbon stream comprising said distillate fraction and hydrogen is introduced into the second catalytic hydrocracking or accucracking reaction zone for conversion into a lower boiling accucracked effluent stream comprising the distillate hydrocarbons boiling in the distillate product range. The accucracked effluent is admixed with the hydrocracked effluent as described above.

17 Claims, 1 Drawing Figure

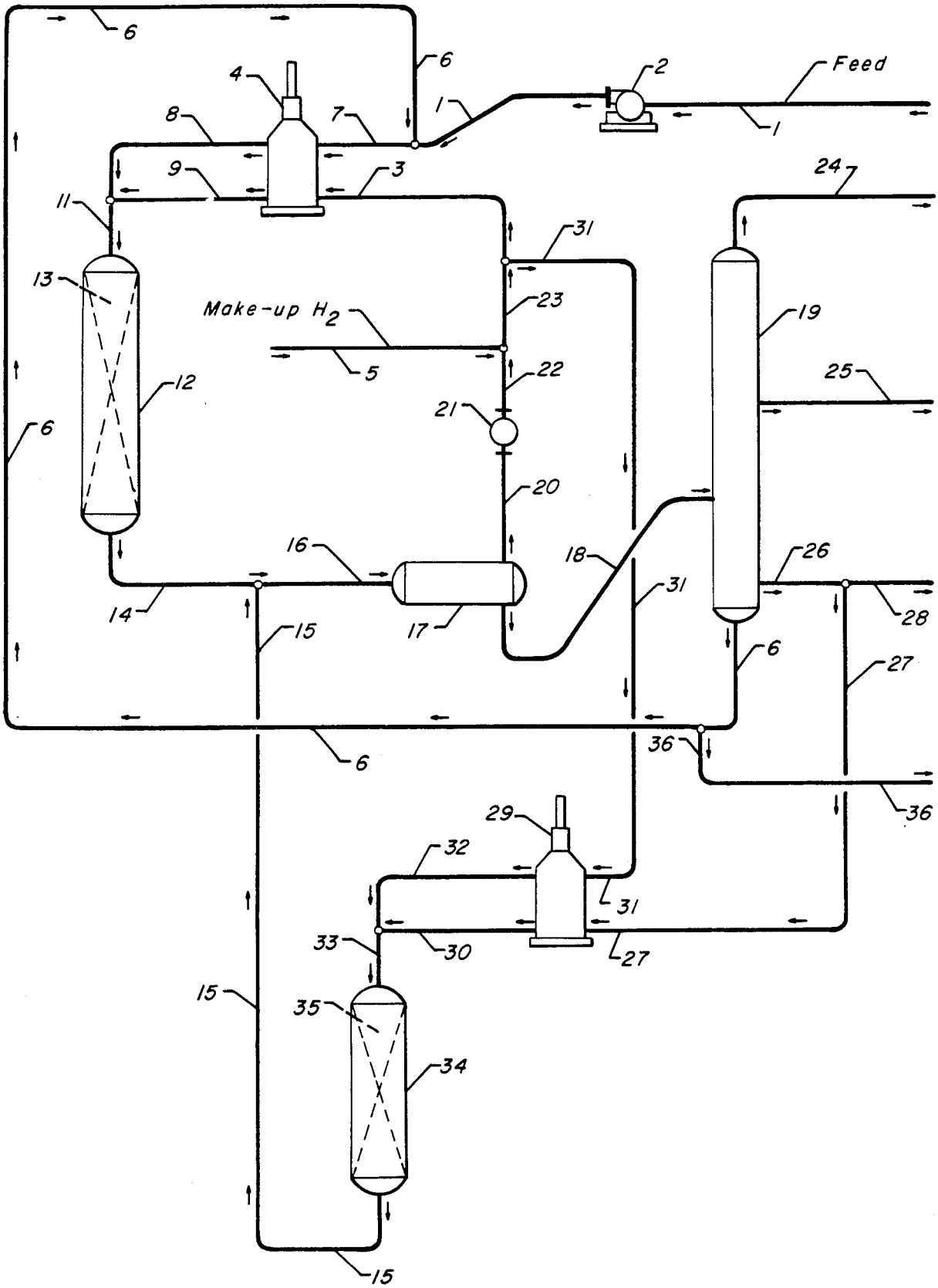
Feed
Make-up $H_2$
1
2
3
4
5
6
7
8
9
11
12
13
14
15
16
17
18
19
20
21
22
23
24
25
26
27
28
29
30
31
32
33
34
35
36

MULTIPLE SINGLE-STAGE HYDROCRACKING PROCESS

BACKGROUND OF THE INVENTION

1. Field of the Invention

The present invention is directed to the field of hydrocarbon conversion. More specifically the present invention involves a hydrocracking process for the conversion of high boiling feedstock to a lower boiling product. The hydrocracking process described herein is a multiple single-stage hydrocracking process employing two hydrocracking reaction zones. It is contemplated that in each hydrocracking zone hydrocarbonaceous material will be contacted with a hydrocracking catalyst at hydrocracking conditions thereby converting the hydrocarbonaceous material to a lower boiling hydrocarbonaceous effluent. The hydrocracking catalysts contemplated by the present invention are those currently known in the art.

Today's refiner is forced to process a wide variety of feedstocks. These feeds include light cycle oils, straight run vacuum gas oils containing high nitrogen and high concarbon and demetallized oils. In addition the refiner must be able to produce a wide variety of products including naphtha, kerosene and diesel fuels. Given such a wide spectrum of available feedstocks and product demand, it is no surprise that flexibility in hydrocracking process design is essential.

The object of the present invention is therefore to provide a flexible hydrocracking process. More specifically, the object of the present invention is to provide a flexible hydrocracking process for converting high boiling heavy contaminated feedstocks to lower boiling jet and diesel fuel products.

The process of the present invention is unique in that it allows for maximum conversion to a desired distillate product boiling in the range of about 100°-700° F. The multiple single-stage hydrocracking process disclosed herein can achieve substantially 100% conversion to the desired distillate product even though such operation may not be feasible or economically attractive in a single-stage operation. The present process can "accucrack" heavy feeds to maximum conversion of a desired distillate product by hydrocracking the feed in a first catalytic hydrocracking reaction zone at conditions to effect substantially 100% conversion of the feed to produce an effluent comprising a predetermined distillate fraction having a higher boiling point than the desired distillate product. A portion of this distillate fraction is then separately converted in a second catalytic hydrocracking or accucracking reaction zone to an accucracked hydrocarbonaceous material comprising the desired distillate product. The yield distribution of the desired distillate product can be adjusted by changing the conversion conditions and/or catalyst composition in the hydrocracking and/or accucracking reaction zones. For example, if a 100% conversion to a jet-fuel product is desired, the first catalytic hydrocracking reaction zone may be operated for 100% conversion of the feed. The effluent from the first reaction zone will comprise a diesel fraction. After separation the diesel fraction may then be converted to the jet-fuel boiling range by accucracking the product in the second catalytic accucracking reaction zone which comprises a catalyst having high selectivity for jet fuel. The accucracked effluent from the second catalytic accucracking reaction zone is commingled with the effluent from the first hydrocracking reaction zone and fed to a common separation zone where the jet-fuel product is withdrawn.

The instant invention allows for maximum conversion of a desired distillate product with the advantage that a total lower catalyst volume may be employed than that which would be required in a single-stage operation. In addition, product quality is improved because the accucracking of the distillate fraction in the second catalytic hydrocracking zone is carried out in a contaminate-free environment which is substantially free of sulfur and nitrogen.

2. Prior Art

It is to be understood that although certain operating conditions and catalytic composites are preferred for use in the present process, neither constitutes an essential feature of the instant invention. The novel flow system herein described does, however, provide the refiner with greater flexibility to choose the type of catalyst and range of operating conditions which may be dictated by the character of the charge stock.

The prior art contains a number of hydrocarbon conversion processes for the conversion of high boiling hydrocarbonaceous materials into lower boiling liquid hydrocarbons. None, however, disclose the instant multiple single-stage hydrocracking flow scheme. The patent discussed below is considered to be typical of the closest prior art.

U.S. Pat. No. 4,197,184 (Munro et al.) discloses a multiple-stage process wherein fresh feed and hydrogen are introduced into a hydrorefining reaction zone to remove contaminates. The hydrorefined product effluent is then admixed with the effluent from a hydrocracking reaction zone and separated into various product streams. Hydrocarbons boiling above a predetermined end boiling point of a desired end product are then introduced with hydrogen into a hydrocracking reaction zone for conversion to lower boiling hydrocarbons.

The process of the Munro et al. patent differs from the present invention. First, the Munro process employs a hydrorefining reaction zone in combination with a hydrocracking reaction zone. The present process employs two hydrocracking reaction zones in combination. Second, while the Munro et al. patent employs a two-reactor scheme, the feed to the hydrocracking reaction zone is merely unconverted, recycled hydrocarbon liquid. In contradistinction, in the present process, the feed to the second hydrocracking reaction zone comprises a predetermined distillate fraction which has been previously cracked in the first hydrocracking zone. The use of prehydrocracked distillate fraction as feed to the second hydrocracking zone in the present invention allows the second zone to be operated at very low temperatures resulting in greater yield stability control. Also, hydrocracking a clean distillate fraction in the second hydrocracking zone eliminates fouling problems in downstream equipment. This is especially advantageous when zeolite containing catalysts, which have been associated with the production of foulant precursors, are employed in the second hydrocracking zone.

SUMMARY OF THE INVENTION

In accordance with the present invention there is provided a hydrocracking process for converting a heavy hydrocarbonaceous charge stock into a lower boiling distillate product having an end boiling point below a predetermined distillate fraction which comprises the steps of: (a) reacting said charge stock and hydrogen in a first catalytic hydrocracking reaction zone at hydrocracking conditions to obtain a hydrocracked effluent stream comprising distillate hydrocarbons boiling in the distillate product range and said distillate fraction; (b) passing the hydrocracked effluent stream and an accucracked effluent stream from a second catalytic hydrocracking reaction zone into a separation zone; (c) withdrawing from the separation zone a vaporous phase comprising hydrogen and a liquid hydrocarbon phase comprising said distillate fraction and said distillate hydrocarbons; (d) fractionating said liquid hydrocarbon phase into at least a light hydrocarbon stream comprising said distillate product, a middle hydrocarbon stream comprising said distillate fraction and a heavy hydrocarbon stream boiling above said distillate fraction; (e) reacting at least a portion of said middle hydrocarbon stream comprising said distillate fraction in the presence of hydrogen in a second catalytic hydrocracking reaction zone at hydrocracking conditions to convert said middle hydrocarbon stream to said accucracked effluent stream comprising distillate hydrocarbons boiling in the distillate product range; (f) recycling at least a portion of said heavy hydrocarbon stream to said first catalytic hydrocracking reaction zone; and (g) withdrawing said light hydrocarbon stream.

DETAILED DESCRIPTION OF THE INVENTION

The instant multiple single-stage hydrocracking process possesses the unique flexibility to obtain maximum conversion of a heavy feedstock to a lower boiling product boiling in the range of about 100°-700° F. This flexibility is achieved by incorporating into the flow scheme described herein a second catalytic hydrocracking or accucracking reaction zone. By the term "accucracking" it is intended to mean the process of converting a distillate fraction in the presence of hydrogen at hydrocracking conditions to a lower boiling product boiling in the range of about 100°-700° F. and below the boiling point of the distillate fraction. By the term "distillate" it is intended to mean any hydrocarbon fraction which has been converted in the presence of hydrogen in a hydrocracking zone at hydrocracking conditions to a lower boiling fraction boiling in the range of about 100°-700° F.

The hydrocarbonaceous feedstock in the present process will comprise all mineral and synthetic oils and fractions thereof boiling in the range of from about 300° F. (150° C.) to about 1200° F. (650° C.). The charge stocks may contain sulfurous and nitrogenous compounds as well as concarbon. Thus, such feedstocks such as light cycle oils, straight run gas oils, vacuum gas oils, demetallized oils, atmospheric residue, deasphalted vacuum residue, shale oil, tar sand oil, coal liquids and the like are contemplated. Preferred feedstocks comprise gas oils, demetallized oils and combinations thereof.

Reaction conditions in either of the hydrocracking zones will be those customarily employed in the art of hydrocracking. Reaction temperatures contemplated are in the range of 200°-1500° F., preferably between 600° F. and 1200° F. Reaction pressures contemplated are in the range of atmospheric to about 3000 psig, preferably between 200 and 3000 psig. Contact times usually correspond to liquid hourly space velocities (LHSV) in the range of about 0.1 hr.$^{-1}$ to 1500 hr.$^{-1}$ preferably between about 0.2 hr.$^{-1}$ and 12 hr.$^{-1}$. Hydrogen circulation rates contemplated are in the range of 1000-50,000 standard cubic feet (scf) per barrel of charge, preferably between 2000 and 30,000 scf per barrel of charge.

Catalytic composites employed in either of the hydrocracking reaction zones are similar to those currently known in the hydrocracking art. The catalytic composites may comprise any known refractory inorganic oxide component. Preferable refractory inorganic oxide components are those selected from the group consisting of alumina, magnesia, silica, titania, zirconia and the like and combinations thereof. The catalytic composite may also comprise a crystalline aluminosilicate or zeolite component. Contemplated zeolites include type X or type Y faujasites, ZSM type, mordenite, Type A, Type U, Type L and the like molecular sieves. The zeolite component may be present as combinations of any known zeolites and may be present in a substantially pure state including the natural or synthetic state. It is also contemplated that the zeolite component may be present in its modified and/or dealuminated form. For example, in the case of faujasite, the unit cell dimension may be in the range of 24.20 A to 24.85 A. Similarly, it is contemplated that the silica to alumina ratio of the zeolite component may range anywhere between typical faujasite ratios of about 2:1 to 10:1 to highly dealuminated forms of ZSM zeolite possessing silica to alumina ratios up to 600:1.

The catalytic composites contemplated by the present invention may also comprise a metal component. In hydrocracking, the hydrogenation function of the catalyst is most often attributed to the metal component. Typical metal components are selected from Groups VIB and VIII of the Periodic Table. Preferable metals include chromium, molybdenum, tungsten, iron Group VIII metals and noble Group VIII metals. Preferable iron Group VIII metals include iron, nickel and cobalt. Preferable noble Group VIII metals include platinum, palladium, rhodium, iridium, ruthenium and osmium. In addition, rhenium is also contemplated as a metal component. The metal components may be present in the elemental state, sulfided state, or as compounds.

Typical catalytic composites will comprise a refractory inorganic oxide carrier material such as silica alumina composited with metal components present in amounts of between about 0.1 weight percent and about 40 weight percent on an elemental basis. In the case where the desired product of the present invention is that which boils in the jet-fuel range a composite such as the above described may be employed in both hydrocracking reaction zones. However, in a case where, for example, naphtha is the desired product, the first hydrocracking zone may employ a catalyst comprising an amorphous refractory oxide such as silica alumina or alumina composited with metal components from Groups VIB or VIII while the second hydrocracking zone may employ a particular accucracking catalyst comprising a zeolitic component either alone or in combination with an amorphous refractory oxide component in admixture with one or more metal components. In any event, it is to be understood that, although certain catalytic composites may be preferred for use in the instant process, any catalytic composite known to possess the known catalytic functions of a hydrocracking catalyst, i.e., hydrogenation and cracking, are contemplated. Moreover, the particular catalyst selected for use in the present process does not constitute an essential feature of the instant invention.

BRIEF DESCRIPTION OF THE DRAWING

A description of the instant process will be made with reference to the accompanying drawing. In the drawing the process is illustrated by way of a simplified diagrammatic flow scheme. It is to be noted that only major vessel and auxiliary equipment are shown. The equipment and unit operations shown are believed sufficient to provide a concise illustration and a clear understanding of the inventive concept. For example, the separator and fractionator are intended to be representative of an entire separation facility complete with either single or multiple columns, reboilers, overhead condensers, and reflux pumps required for the recovery of a plurality of product streams. The hydrocracking reaction zones are intended to be representative of an entire reaction operation which includes hydrogen quenched streams, pressure and temperature control apparatus and the like. Other details have been reduced in number or completely eliminated as being nonessential to an understanding of the techniques employed by the present invention. The use of such miscellaneous equipment to modify the process as illustrated is well within the purview of one skilled in the appropriate art and will not remove the instant process beyond the scope and spirit of the appended claims.

DETAILED DESCRIPTION OF THE DRAWING

With specific reference to the accompanying drawing, charge stock is introduced into the process by way of conduit 1. Pump 2 raises the pressure of the feedstock to at least equal to the system pressure. The charge stock continues by way of line 1 and is admixed with the heavy hydrocarbon recycle stream 6. The charge stock and recycle admixture continues by way of line 7 into heater 4. Heater 4 further raises the temperature of the recycle charge stock admixture to a level commensurate with the catalyst bed inlet design temperature. The heated mixture passes through conduit 8 and is admixed with heated hydrogen from line 9 which has also been heated in heater 4. The hydrogen may be recycle hydrogen derived from separator 17, and line 20, pump 21 and lines 22, 23 and 3. The hydrogen may also be makeup or fresh hydrogen introduced in line 5 which may be admixed with the above-described recycle hydrogen in line 23. Regardless of its source, the hydrogen in line 3 as aforesaid, is heated in heater 4 to produce the heated hydrogen in line 9 which is admixed with the heated recycle/charge stock admixture in line 11.

The heated hydrogen and recycle/charge stock admixture passes through conduit 11 into the first catalytic hydrocracking reaction zone 12 wherein it contacts catalyst bed 13. The hydrocracked effluent withdrawn via line 14 comprising a predetermined distillate fraction is admixed with the accucracked effluent stream from line 15 in line 16. The admixed effluent continues through line 16 to separator 17. Prior to entering separator 17 the admixed effluent may first be used as a heat exchange medium to raise the temperature of other process streams or may be partially condensed. In either event, once in separator 17, a normally liquid hydrocarbon stream comprising the desired distillate fraction, distillate product and any adsorbed vaporous material is withdrawn via line 18 and introduced into fractionator facility 19. A hydrogen-rich vaporous phase which may contain some of the lower boiling entrained liquid components as well as vaporous components comprising sulfur, nitrogen, and other contaminants present in the charge stock is recovered by way of conduit 20.

The admixed effluent in line 16 or the individual product effluents in lines 14 and 15, respectively, may be treated in any suitable well-known manner for the removal of ammonia and hydrogen sulfide. For example, water may be added to either of the product lines while separator 17 is equipped with a water boot to remove water containing substantially the ammonia. The vaporous phase in line 20 may be introduced into an amine scrubbing system for the adsorption of hydrogen sulfide. In any event, these contaminating components will be withdrawn from the process prior to employing any of the vaporous phase in line 20 as recycled hydrogen. The recycled hydrogen recovered in line 20 is introduced into recycle compressor 21. Makeup hydrogen may be introduced by way of line 5 and admixed with compressed recycle hydrogen from line 22 in line 23.

Fractionator 19 serves to separate the normally liquid hydrocarbon stream into the desired hydrocarbon streams. Normally gaseous material will be withdrawn as an overhead stream in line 24. The light hydrocarbon stream comprising said distillate product and having a boiling point below the predetermined distillate fraction is withdrawn via conduit 25. The light hydrocarbon stream in conduit 25 may be subsequently separated into a plurality of hydrocarbon streams so that the distillate product may be obtained therefrom. The middle hydrocarbon stream comprising said predetermined distillate fraction is withdrawn via conduit 26. At least a portion of said middle hydrocarbon stream is channeled by way of conduit 27 to direct heater 29. The remaining portion of said hydrocarbon stream may be drawn off in line 28 for further processing. The heavy hydrocarbon stream comprising hydrocarbons boiling above said distillate fraction is withdrawn in conduit 6 and recycled to admixture with said charge stock in conduit 7 as above described. A portion of the heavy hydrocarbon stream may be drawn off in line 36 as a drag stream or may be employed as a recycle stream to the second catalytic hydrocracking reaction zone 34.

The portion of said middle hydrocarbon stream comprising said distillate fraction is heated in heater 29 to raise the temperature to a level commensurate with the designed catalyst bed inlet temperature of the second catalytic hydrocracking reaction zone 34. The second catalytic hydrocracking reaction zone 34 preferably possesses an environment which is contaminant free. The term "contaminant free" may be defined as meaning substantially free of sulfur and nitrogen compounds. Thus, in the case of nitrogen, preferred nitrogen levels are below 20 weight ppm and more preferably less than 5 weight ppm. In the case of sulfur, preffered sulfur levels are below 200 weight ppm and more preferably less than 50 weight ppm. It is to be understood, however, that even though preferable, a contaminant free environment is not a necessary element of the invention. The heated middle hydrocarbon stream passes through conduit 30 and is admixed with heated hydrogen in conduit 33. The heated hydrogen is obtained from hydrogen passing through conduit 31 and heated in heater 29. The hydrogen in line 31 is derived from either makeup hydrogen provided by lines 5 and 23, or recycled hydrogen provided by separator 17, line 20, compressor 21 and lines 22 and 23. As above stated, hydrogen may be obtained from either recycled or makeup hydrogen or a combination thereof. It is to be noted, however, that since the second catalytic reaction zone is contaminant free, as described above, the hydrogen fed to the second zone will be free of contaminating sulfur and nitrogen compounds. Thus, for example, any recycle hydrogen will most likely be scrubbed for $H_2S$ removal prior to recycle to the second zone.

In any event, the heated hydrogen/middle hydrocarbon stream mixture in line 33 passes into the second catalytic hydrocracking reaction zone 34 and is contacted with the second catalyst bed 35. In the second hydrocracking reaction zone 34 the middle hydrocarbon stream comprising said distillate fraction is reacted to convert said distillate fraction to produce an accucracked effluent stream 15 comprising said distillate product. Said accucracked effluent stream 15 comprising said distillate product is then admixed with the hydrocracked effluent stream comprising said distillate product and said distillate fraction to form said admixed effluent stream 16. Said admixed effluent stream 16 is then fed to separator 17 as described above.

EXAMPLE I

This example illustrates the process of the present invention operated for maximum production of a distillate product boiling in the range of 300°-550° F. when a zeolitic catalyst is employed in the second reaction zone. The predetermined distillate fraction fed to the second catalytic hydrocracking reaction zone had a boiling range of 550°-700° F. which was higher than the distillate product. The fresh feed to the first catalytic hydrocracking reaction zone was a vacuum gas oil having the properties given in Table 1.

TABLE 1

| VGO Feed | | | |
|---|---|---|---|
| Gravity, °API | 22.5 | IBP °F. | 578 |
| Sulfur, wt. % | 1.97 | 10/30 | 826/856 |
| Nitrogen, ppm | 434 | 50/70 | 892/927 |
| Aromatics, vol. % | 50.6 | 90/EP | 976/1003 |

After heating, the VGO feed was contacted with an amorphous silica-alumina catalyst impregnated with nickel and tungsten in the first catalytic reaction zone. The conditions in the first zone were: Pressure 2500 psig, liquid hourly space velocity (LHSV) 0.5 hr.$^{-1}$, and a hydrogen circulation of 12,000 standard cubic feet per barrel (scfb).

The hydrocracked effluent from the first catalytic hydrocracking reaction zone contained 40.2 weight percent based on fresh feed (weight percent FF) distillate product boiling in the range of 300°-550° F. and 32.7 weight percent FF distillate fraction boiling in the range of 550°-700° F. The hydrocracked effluent was then admixed with the accucracked effluent derived from the second catalytic hydrocracking reaction zone to form an admixed effluent stream. After separation of hydrogen-rich gases, the liquid admixed effluent stream was fractionated into a light hydrocarbon stream cut at 550° F. and comprising the distillate product, a middle hydrocarbon stream cut at 700° F. and comprising the distillate fraction, and a heavy hydrocarbon stream comprising hydrocarbons boiling above 700° F. The heavy hydrocarbon stream was recycled to the first catalytic reaction zone at a combined feed ratio (CFR) of 1.5.

The middle hydrocarbon stream comprising the distillate fraction (b.p. 550°-700° F.) had the following properties:

| | | | |
|---|---|---|---|
| Gravity, °API | 40.2 | IBP °F. | 535 |
| Sulfur, wt. % | 0.01 | 10/30 | 549/564 |
| Nitrogen, ppm | 0.9 | 50/70 | 580/617 |
| Aromatics, vol. % | 12.2 | 90/EP | 672/700 |

After heating, the middle hydrocarbon stream was contacted with a zeolitic Y faujasite/amorphous alumina catalyst impregnated with nickel and tungsten contained in the second catalytic hydrocracking reaction zone to produce the accucracked effluent. The conditions in the second reaction zone were: Pressure 2500 psig, LHSV 3.0 hr.$^{-1}$, and hydrogen circulation 10,000 scfb. As mentioned above, the accucracked effluent comprising distillate product (b.p. 300°-550° F.) was admixed with the hydrocracked effluent to form the admixed effluent which, after separation, was fractionated.

The instant process yielded a product distribution comprising 48.1 weight percent FF distillate product and only 6.8 weight percent FF distillate fraction. Thus, the multi-single stage accucracking process of the present invention increased production of the distillate product from 40.2 weight percent FF to 48.1 weight percent FF through the accucracking of the distillate fraction. This is evident by noting that the distillate fraction yield decreased dramatically from 32.7 weight percent FF to 6.8 weight percent FF when the distillate fraction was converted in the accucracking reactor.

EXAMPLE II

The following is an illustration where the process of the present invention may be operated for maximum production of a distillate product boiling in the range of 100°-300° F. In this case the predetermined distillate fraction to be fed to the second catalytic hydrocracking zone will have a boiling range of 300°-700° F. which is higher than the distillate product. The fresh feed to the first catalytic hydrocracking reaction zone is a vacuum gas oil having the properties given in Table 1. After heating, the VGO feed is contacted with an amorphous silica alumina catalyst impregnated with nickel and tungsten in the first zone. The conditions in the first zone include: Pressure 2500 psig, LHSV 0.5 hr.$^{-1}$ and a hydrogen circulation of 12,000 scfb. The hydrocracked effluent from the first catalytic zone will contain 16.5 weight percent FF distillate product boiling in the range of 100°-300° F. and 72.9 weight percent FF distillate fraction boiling in the range of 300°-700° F. In accordance with the present invention the hydrocracked effluent is admixed with the accucracked effluent derived from the second catalytic hydrocracking reaction zone to form the admixed effluent stream. After separation of hydrogen rich gases, the liquid admixed effluent stream is fractionated into a light hydrocarbon stream cut at 300° F. and comprising the distillate product, a middle hydrocarbon stream cut at 700° F. and comprising the distillate fraction and a heavy hydrocarbon stream comprising hydrocarbons boiling above 700° F. The heavy hydrocarbon stream is recycled to the first catalytic reaction zone at a combined feed ratio of 1.5.

The middle hydrocarbon stream comprising the distillate fraction (b.p. 300°-700° F.) will have the following properties:

| | | | |
|---|---|---|---|
| Gravity, °API | 42.6 | IBP °F. | 329 |
| Sulfur, wt. % | .0078 | 10/30 | 351/403 |
| Nitrogen, ppm | 0.5 | 50/70 | 477/575 |
| Aromatics, vol. % | 15.2 | 90/EP | 672/699 |

After heating, the middle hydrocarbon stream is contacted with a zeolitic Y faujasite/amorphous alumina catalyst impregnated with nickel and tungsten contained in the second catalytic hydrocracking reaction zone to produce the accucracked effluent. The conditions in the second reaction zone include: Pressure 2500 psig, LHSV 3.0 hr.$^{-1}$ and hydrogen circulation 10,000 scfb. As mentioned above, the accucracked effluent comprising distillate product (b.p. 100°-300° F.) is admixed with the hydrocracked effluent to form the admixed effluent which, after separation, is fractionated.

The instant process will yield a product distribution comprising 63.5 weight percent FF distillate product and only traceable quantities of the distillate fraction. Thus, the multi-single stage accucracking process, as illustrated herein, can increase the production of distillate product from 16.5 weight percent FF in a single stage operation to 63.5 weight percent FF in the multistage accucracking operation.

EXAMPLE III

This example illustrates the process of the present invention operated for maximum production of a distillate product boiling in the range of 300°-550° F. when an amorphous catalyst is employed in the second reaction zone. The predetermined distillate fraction fed to the second catalytic hydrocracking reaction zone had a boiling range of 550°-700° F. which was higher than the distillate product. The fresh feed to the first catalytic hydrocracking reaction zone was a vacuum gas oil having the properties given in Table 2.

TABLE 2

| VGO Feed | | | |
|---|---|---|---|
| Gravity, °API | 20.1 | IBP °F. | 565 |
| Sulfur, wt. % | 1.43 | 10/50 | 735/845 |
| Nitrogen, ppm | 1400 | 90 | 995 |
| ConCarbon, wt. % | 0.5 | EP (95% over) | 1037 |

After heating, the VGO feed was contacted in the first reaction zone with an amorphous silica-alumina catalyst impregnated with nickel and tungsten. The conditions in the first zone were: pressure 2500 psig, LHSV 0.67 hr.$^{-1}$, and a hydrogen circulation of 10,700 scfb. The first reaction zone was carried out at 100% conversion to a 700° F. end point with a 1.39 CFR.

The hydrocracked effluent from the first catalytic hydrocracking reaction zone contained 44.3 weight percent FF distillate product boiling in the range of 300°-550° F. and 40.0 weight percent FF distillate fraction boiling in the range of 550°-700° F. The hydrocracked effluent was then admixed with the accucracked effluent derived from the second catalytic hydrocracking reaction zone to form an admixed effluent stream. After separation of hydrogen-rich gases, the liquid admixed effluent stream was fractionated into a light hydrocarbon stream cut at 550° F. and comprising the distillate product and a middle hydrocarbon stream cut at 700° F. and comprising the distillate fraction.

The middle hydrocarbon stream comprising the distillate fraction (b.p. 550°-700° F.) was contacted in the second reaction zone with an amorphous silica alumina catalyst impregnated with nickel and tungsten. The conditions in the second reaction zone were: pressure 2500 psig, LHSV 1.5 hr.$^{-1}$, and hydrogen circulation of 7,500 scfb. The second reaction zone was carried out at 100% conversion to a 550° F. end point with a CFR of 1.5. The accucracked effluent comprising distillate product (b.p. 300°-550° F.) from the second reaction zone was admixed with the hydrocracked effluent to form the admixed effluent as mentioned above.

The instant process yielded an overall product distribution comprising 73.3 weight percent FF distillate product and no distillate fraction. Thus, the process of the present invention increased production of the distillate product from 44.3 weight percent FF to 73.3 weight percent FF through accucracking of the distillate fraction.

What is claimed is:

1. A hydrocracking process for converting a heavy hydrocarbonaceous charge stock having an end boiling point greater than about 700° F. into a lower boiling distillate product which comprises the steps of:

(a) reacting said charge stock and hydrogen in a first catalytic hydrocracking reaction zone at hydrocracking conditions to obtain a first hydrocracked effluent stream comprising distillate hydrocarbons boiling in a distillate product range and uncoverted charge stock boiling above about 700° F.;

(b) passing said hydrocracked effluent stream and a second hydrocracked effluent stream from a second catalytic hydrocracking reaction zone into a separation zone;

(c) withdrawing from said separation zone a vaporous phase comprising hydrogen and a liquid hydrocarbon phase comprising hydrocarbons boiling in a distillate product range and unconverted charge stock;

(d) fractionating said liquid hydrocarbon phase into a light hydrocarbon stream comprising at least a portion of said hydrocarbons boiling in a distillate product range, a middle hydrocarbon stream comprising at least a portion of said hydrocarbons boiling in a distillate product range, said light hydrocarbon stream having a boiling range which is lower than the boiling range of the middle hydrocarbon stream, and a heavy hydrocarbon stream comprising unconverterd charge stock boiling above about 700° F.;

(e) reacting at least a portion of said middle hydrocarbon stream comprising at least a portion of said hydrocarbons boiling in a distillate product range and hydrogen in a second catalytic hydrocracking reaction zone at hydrocracking conditions to convert said middle hydrocarbon stream to lower boiling hydrocarbons boiling in a distillate product range;

(f) recycling at least a portion of said heavy hydrocarbon stream comprising unconverted charge stock boiling above about 700° F. to said first catalytic hydrocracking reaction zone; and (g) withdrawing said light hydrocarbon stream.

2. The process of claim 1 wherein the hydrogen of step (c) is separated from said vaporous overhead phase and said hydrogen is recycled to said first reaction zone.

3. The process of claim 2 wherein extrinsic hydrogen is added to said first reaction zone.

4. The process of claim 1 wherein either of said first or second reaction zones contains a catalyst comprising at least one metal component selected from Group VIB and Group VIII of the Periodic Table.

5. The process of claim 4 wherein the said metal component is selected from the group consisting of molybdenum, tungsten, cobalt, nickel and combinations thereof.

6. The process of claim 1 wherein either of said first or second reaction zones contains a catalyst comprising alumina.

7. The process of claim 1 wherein either of said first or second reaction zones contains a catalyst comprising silica.

8. The process of claim 1 wherein either of said first or second reaction zones contains a catalyst comprising silica and alumina.

9. The process of claim 1 wherein either of said first or second reaction zones contains a catalyst comprising a zeolite.

10. The process of claim 9 wherein said zeolite is selected from the group consisting of zeolite X, mordenite, zeolite Y or combinations thereof.

11. The process of claim 1 wherein either of said first or second reaction zones contains a catalyst comprising a crystalline zeolite component in admixture with a silica-alumina component.

12. The process of claim 11 wherein said zeolite component comprises zeolite X, zeolite Y, mordenite or combinations thereof.

13. The process of claim 1 wherein either of said first or second reaction zones operates at hydrocracking conditions which include a temperature in the range of about 600° F. (315° C.) to 1200° F. (650° C.) and a pressure in the range of about 200 psig to 3000 psig.

14. The process of claim 1 wherein said middle hydrocarbon stream comprises less than 20 weight ppm nitrogen and less than 200 weight ppm sulfur.

15. The process of claim 1 wherein said charge stock comprises hydrocarbons boiling in the range of about 300° F. (150° C.) to 1200° F. (650° C.).

16. The process of claim 1 wherein said middle hydrocarbon distillate product has a boiling range of about 300°-550° F.

17. The process of claim 1 wherein said light hydrocarbon distillate product has a boiling range of about 100°-300° F.

* * * * *